US005867583A

United States Patent [19]

Hazelwood et al.

[11] Patent Number: 5,867,583

[45] Date of Patent: Feb. 2, 1999

[54] TWIST-LOCK-MOUNTABLE VERSATILE LOUDSPEAKER MOUNT

[75] Inventors: Robert E. Hazelwood, Amesbury, Mass.; Ronnie S. Espiritu, Castaic, Calif.; Gorm H. Jørgensen, Dragør, Denmark

[73] Assignee: Harman International Industries, Inc., Northridge, Calif.

[21] Appl. No.: 828,930

[22] Filed: Mar. 28, 1997

Related U.S. Application Data

[60] Provisional application No. 60/014,384 Mar. 28, 1996.

[51] Int. Cl.[6] ..... H04R 25/00

[52] U.S. Cl. ..... 381/395; 381/386; 181/199

[58] Field of Search ..... 381/193, 188, 381/205, 332, 86, 386, 388, 389, 395, 398, 153, 151, 165, 152, 87; 181/150, 171, 199

[56] References Cited

U.S. PATENT DOCUMENTS

| | | | |
|---|---|---|---|
| 4,032,725 | 6/1977 | McGee | 381/205 |
| 4,815,558 | 3/1989 | Krainhofer | 381/205 |
| 4,852,178 | 7/1989 | Inkman et al. | 381/205 |

*Primary Examiner*—Huyen Le
*Attorney, Agent, or Firm*—J. E. McTaggart

[57] ABSTRACT

An improvement in small round loudspeakers of popular standard types used in vehicle assembly is obtained by modifying a standard-sized basket in a manner to provide a polar array of special mounting openings located on a concentric mounting circle of larger than standard diameter, thus allowing the use of a larger cone for improved performance and allowing the loudspeaker to be mounted in different-sized popular mounting hole patterns in the baffle panel; for example an aspect of the invention enables the "6.5 inch basket", associated with Asian-built vehicles, to be fitted with a larger-sized cone used in the "170 mm basket" associated with European-built vehicles, thus providing a loudspeaker, with the improved performance of the larger cone, that can be installed in a range of different baffle panel cutout sizes and configurations of either type of vehicle. In a twist-lock embodiment, an array of elongated slots, typically four, configured in the rear side of the peripheral mounting flange of the loudspeaker, enables twist-lock installation and removal, by engaging a corresponding array of specially-shaped lock tabs associated with the baffle panel. The lock tabs may formed on a sheet metal ring that can be attached to the baffle panel by bolts, screws, rivets or other fasteners prior to installing the loudspeaker. A forward-facing raised landing surface of the loudspeaker flange, which normally carries protruding mounting screw heads, is left clear to provide an unobstructed flat surface for adhesive attachment of the surround suspension of the larger cone.

14 Claims, 5 Drawing Sheets

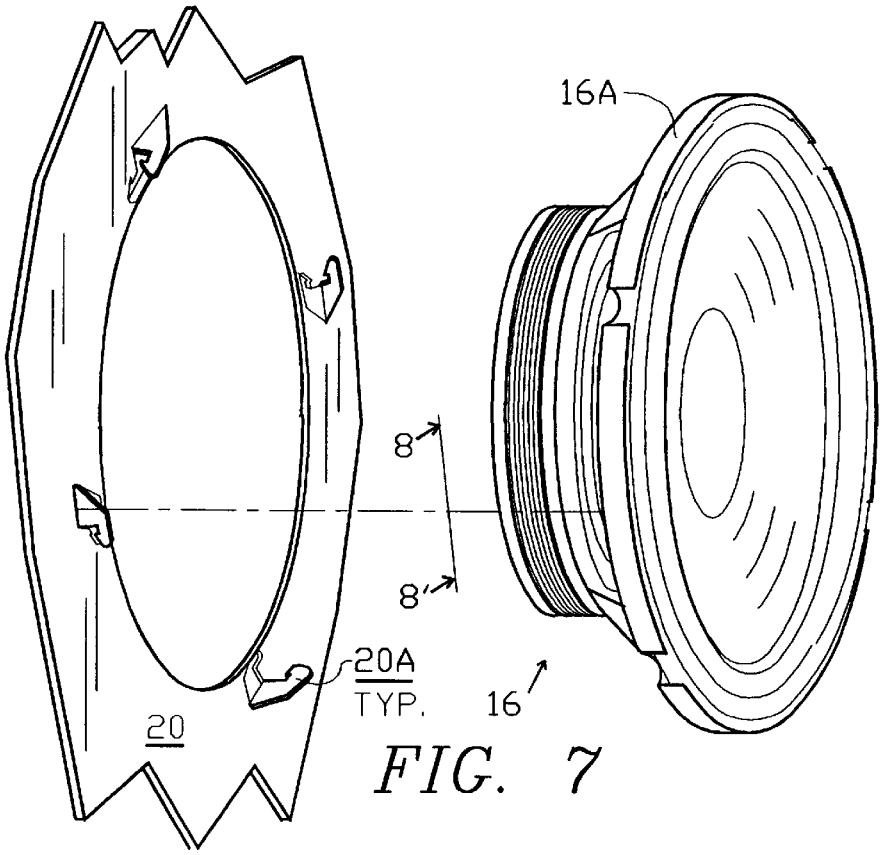
FIG. 7
FIG. 8A
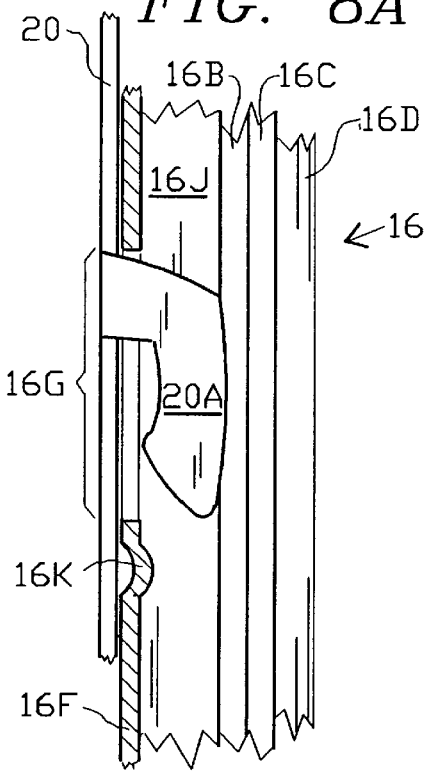
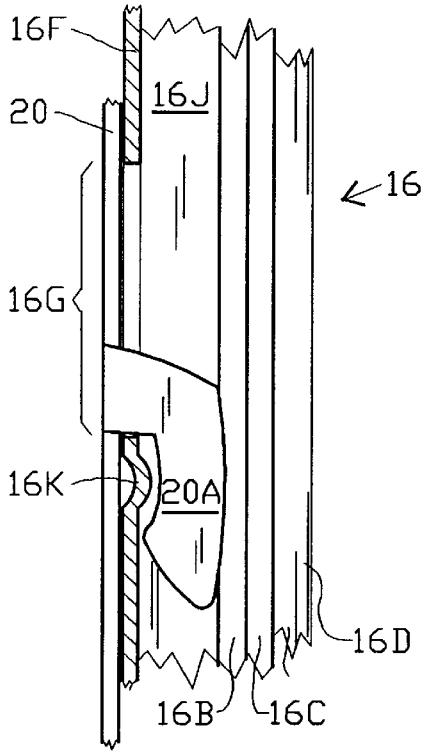
FIG. 8B

FIG. 9
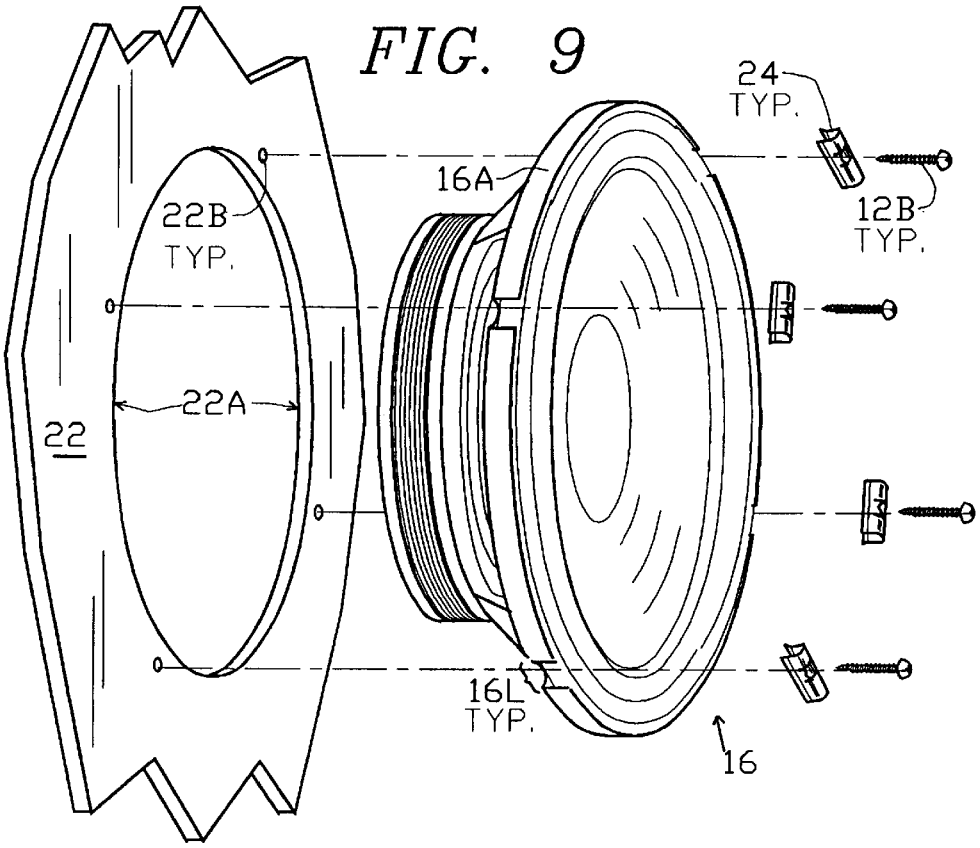
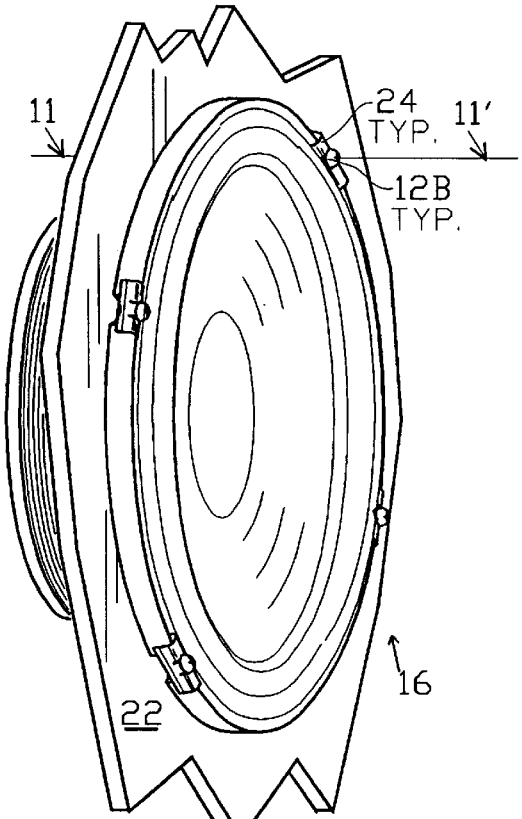
FIG. 10
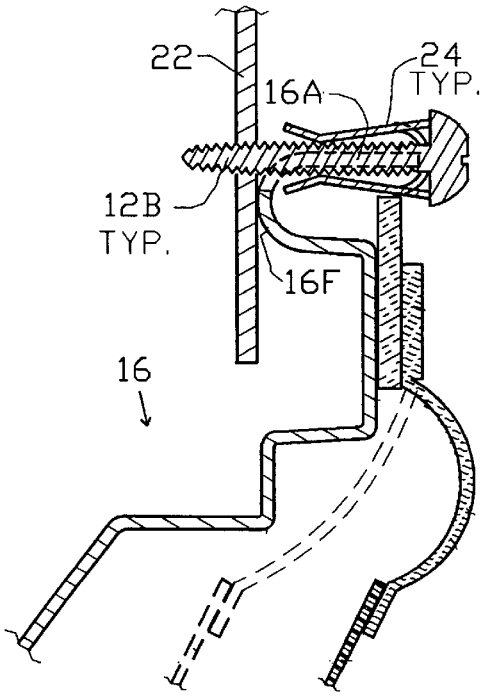
FIG. 11

TWIST-LOCK-MOUNTABLE VERSATILE LOUDSPEAKER MOUNT

Benefit is claimed under 35 U.S.C. § 119(e) for U.S. provisional application 60/014384 filed Mar. 28, 1996.

FIELD OF THE INVENTION

The present invention relates to the field of audio loudspeakers, and more particularly it relates to a versatile compact circular speaker configuration, directed to vehicular usage, that can functionally and mechanically replace either of two different-sized speaker types which are in common use but which are ordinarily non-interchangeable, and that enables a twist-lock system of rapid mounting and dismounting.

BACKGROUND OF THE INVENTION

Most vehicles are now equipped with an audio system: commonly this is already installed in new vehicles as original factory installation. It is not unusual for a vehicle to be equipped with four or more speakers. Since space is usually restricted, compact door-mounted speakers are popular. The present invention is directed to compact speakers having a circular outline, as opposed to an elliptical or square outline.

Two predominant types of compact circular speakers that are widely used in vehicles are close in size: 6.5" nominal (165 mm) associated largely with Asian-produced vehicles and with Japanese industry JIS standards, and 170 mm nominal (6.7") associated largely with European-produced vehicles and with DIN standards. Many American-produced as well as imported vehicles are made with compact round speaker mounting cutout/hole patterns of one or other of these two types, depending on the vehicle make and year.

Although these two types are close in size, the dimensional differences in mounting patterns are such as to ordinarily prevent interchangeability between the two speaker types. Furthermore, since the 170 mm type has about 14% larger cone area than the 6.5" type, it is considered superior for bass frequency performance capability since its larger cone produces a given SPL (sound pressure level) with a shorter travel and therefore requires less clearance to prevent the diaphragm system from "bottoming" at low bass frequencies. Thus any purely mechanical adaptation of the smaller speaker that is presently known and/or available for replacing the larger speaker would fail to duplicate its inherently higher performance capability.

The manner of mounting speakers in vehicles is important both in original vehicle manufacturing, where rapid and easy installation on the assembly line is of great importance for the labor cost savings, and in vehicle sound servicing where both installation and removal of a speaker represent time and cost expenditures.

The most common speaker locations in vehicles is in the side doors where typically speakers are mounted onto the interior sheet metal panel, extending into the door compartment; rear speakers can be located in a bulkhead panel behind the rear seat cushion, where they are typically mounted to the rear of the bulkhead panel, facing forwardly in the vehicle.

Typically, circular speakers are made with an array of mounting holes located just inside the rim for fastening the speaker in place with a set of mounting screws. If the mounting panel is of sheet metal, these mounting screws are typically self-tapping screws driven into suitably sized round holes; alternatively the holes may be extruded and threaded to accept machine screws. In either case, installation and removal are relatively easy and labor-efficient when no fastening hardware is required on the reverse side of the mounting panel.

However where fastening hardware is required on the reverse side, e.g. where the mounting panel material is unsuitable for reliably threading or engaging self-tapping screws, such assembly tends to be slow and costly: since the main opening is occupied by the speaker itself, lack of rear accessibility may require two workers to install or remove the speaker.

In a compact speaker for the automobile marketplace, bass performance capability is a key parameter, also the product must be easily mountable into the standard speaker openings provided in popular vehicle models. It is highly desirable to minimize the number of different sized speakers that need to be produced; for example it would be a manufacturing and distributing economy to provide a single versatile speaker type that could be mounted in standard speaker mounting cutouts of either the 6.5" or the 170 mm type. The versatile speaker type would require a cone size that would provide the performance of the 170 mm unit; this would provide a performance bonus in the 6.5" applications.

To suspend the edge of the cone, it is conventional practice to provide a surround suspension member having an arched resilient portion with its inner edge attached to the cone edge and its outer edge extended in the form of a surround suspension mounting flange which is adhesively attached to the rim portion of the speaker frame, typically via a spacer ring.

In contemplating speakers as candidates for OEM (original equipment manufacture) of automobiles or as an OEM replacement, it is a ground rule that there can be no physical modification of the speaker mounting panel, assuming it is part of a vehicle, such as drilling, cutting, bending etc., since such would void the vehicle warranty.

DISCUSSION OF RELATED PRIOR ART

Examples of speaker mounting systems directed to quick mounting of compact round speakers in cut-outs of various existing panels are found in U.S. Pat. Nos. 4,815,558 to Krainhofer, assigned to U.S. Philips Corp., and 4,852,178 to Inkman et al, assigned to Motorola, Inc. These disclose quick-fastening speaker retaining assemblies comprising an intermediate support plate fitted with a plurality of latched posts; a ring frame placed over the speaker rotationally engages the latches in the posts to retain the speaker against the frame and the plate in a manner similar to that used in mounting kitchen garbage disposal units. Inkman shows four posts while Krainhofer shows two posts.

OBJECTS OF THE INVENTION

It is a primary object of the present invention to provide a configuration for a versatile compact round speaker that is capable of fitting into two different sized speaker mounting patterns intended for speakers of two different size types which are ordinarily not interchangeable.

It is a further object to provide, in a particular embodiment, a versatile compact round speaker configuration that can be readily installed into either a 6.5" or a 170 mm. type vehicular speaker mounting cutout pattern without modifying the cutout pattern.

It is a further object that the versatile speaker have a cone area equal to that of the larger of the two speaker types it is intended to replace, and in the particular embodiment to have a cone area at least equal to that of a 170 mm type speaker.

It is a still further object that the versatile configuration have an outside frame diameter equal to that of the smaller of the two speaker types, thus accomplishing an increase in cone area relative to outside frame diameter, compared to that of heretofore known art.

It is a further object to provide a speaker mounting system such that the speaker can be quickly and easily installed, and in the case of a particular embodiment, a mounting system that enables the speaker to be later removed and re-installed without tools and without driving or removing screws.

It is a further object to provide a speaker-mounting system that can accommodate panels of various materials, particularly materials unsuitable for threaded holes or self-tapping screws, and which thus require behind-panel nut fastenings.

It is a further object to provide a speaker-mounting system that allows any required behind-panel nut fastenings to be assembled and tightened easily, due to accessibility through the main circular speaker opening.

It is a still further object to provide the versatile speaker configuration with capability of mounting against the rear of a panel as well as the more common mounting against the front of a panel.

SUMMARY OF THE INVENTION

The above mentioned objects have been accomplished by the present invention of a configuration wherein an array of slots, provided in the outer rim region of the speaker, are made and arranged to mate with a corresponding array of specially-shaped lock tabs associated with the mounting panel.

In a preferred embodiment the tabs are formed integrally on a mounting ring, which is attached, typically by screws, to the panel around the speaker cutout, such that the speaker can be easily mounted and removed in a twist-lock manner. The screw heads retaining the mounting ring become fully enclosed by the speaker rim channel so that a landing portion overhead provides a smooth surface for attachment of the surround flange, enabling the use of the larger diameter cone of the 170 mm speaker in the 6.5" style frames In another embodiment the tabs are formed directly in the mounting panel so that a separate mounting ring is not required. The mounting panel itself may be made removable from the vehicle, in which case it may be regarded as a variation of the aforementioned mounting ring.

For mounting the versatile speaker in the standard mounting hole pattern of the larger speaker type, where the mounting hole locations coincide with the speaker rim, an array of notches are provided around the speaker rim, and a spring clip at each notch couples the mounting screw to the rim. A similar spring clip can be used in a reversed manner for mounting the versatile speaker against the rear side of a panel that is provided with the large mounting hole pattern.

BRIEF DESCRIPTION OF THE DRAWINGS

The above and further objects, features and advantages of the present invention will be more fully understood from the following description taken with the accompanying drawings in which:

FIG. 7 is a three-dimensional view of the versatile speaker of the present invention in a pre-installation position in front of a mounting panel formed with integral twist-lock tabs, as an alternative to the use of the mounting ring of FIG. 4.

FIG. 8A is an enlarged cross-section taken at axis 8-8' of FIG. 7 showing a typical tab location, with the speaker initially mounted in place against the panel such that the tabs have entered slots in the speaker rim channel.

FIG. 8B shows the items in FIG. 8A after rotationally shifting the speaker frame clockwise to a locked position with the tabs engaging corresponding detent protrusions in the speaker rim channel.

FIG. 9 is a three-dimensional exploded pre-installation view of a panel having an oversize mounting hole pattern, a versatile speaker of the present invention and spring clip mounting hardware that enables the speaker to be mounted in the oversize hole pattern utilizing rim notches in the speaker.

FIG. 10 shows the versatile speaker of the present invention mounted to the front of the panel of FIG. 9 utilizing clips and screws.

FIG. 11 is an enlarged cross-section taken at axis 11-11' of FIG. 10, showing detail at a typical mounting screw location.

DETAILED DESCRIPTION

Figure 1:
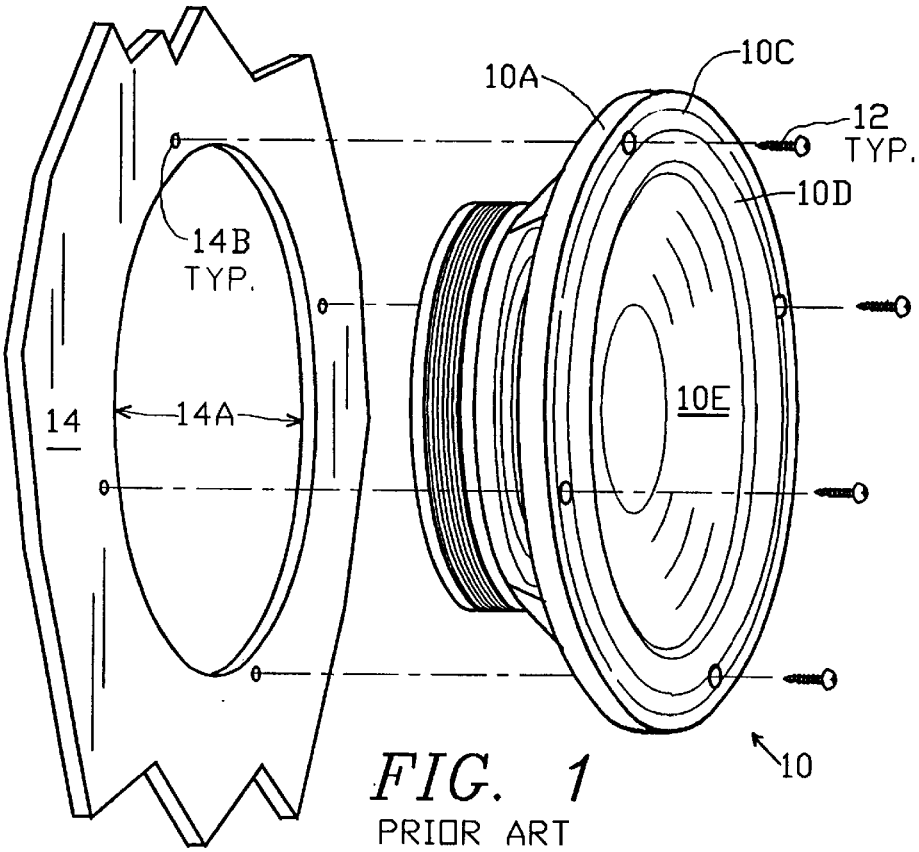
FIG. 1 PRIOR ART
FIG. 1 is a three-dimensional view of a compact circular speaker of known art, shown in a pre-installation location beside a mounting panel having a standard round speaker opening.

FIG. 1 depicts a speaker 10 of known art intended for mounting in a panel 14 having a mounting pattern consisting of a circular opening 14A and four associated holes 14B, typical of vehicle installation, e.g. in a door panel.

For illustrative purposes relating to the following disclosure, speaker 10 can be considered to represent a widely used "6.5 inch" speaker type associated with many vehicles of Asian and American design and manufacture, having typically a sheet metal circular basket with an outside diameter of 157 mm (6.18") at the rim 10A. Typically the cone has a diameter of 111.8 cm, thus a calculated area of 98.17 square centimeters.

The pattern of the four mounting holes 14B is on a circle 142 mm in diameter. Four mounting holes are provided in speaker 10 through the speaker mounting flange around the rim 10A corresponding to the locations of four screws 12 as shown. Speaker 10 is typically mounted to panel 14 by the four screws 12 passing through the speaker mounting holes and through the corresponding holes 14B in panel 14. Screws 12 can be self-tapping or machine screws; holes 14B are sized accordingly, and may be extruded and/or tapped for machine screw engagement. Alternatively, e.g. where the material of panel 14 is unsuitable for anchoring screws reliably, screws 12 may be machine screws retained by rear nut fastenings such as Tinnerman nuts, tee nuts or by machine nuts typically each accompanied by a flat washer and a lockwasher; for this type of mounting holes 14B are dimensioned to clear the screws.

Figure 2:
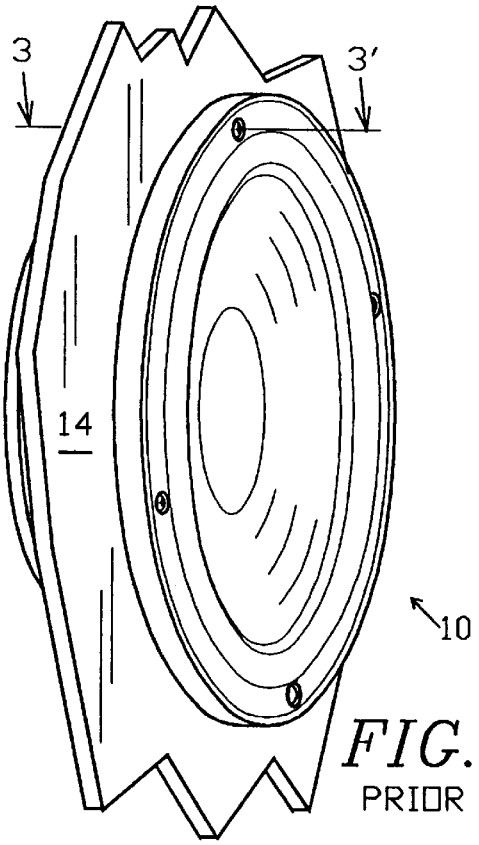
FIG. 2 PRIOR ART
FIG. 2 shows the speaker and mounting panel of FIG. 1 after final assembly together in a typical speaker installation of known art.

FIG. 2 shows the speaker 10 mounted in place against panel 14 by four screws whose recessed heads can be seen.

Figure 3:
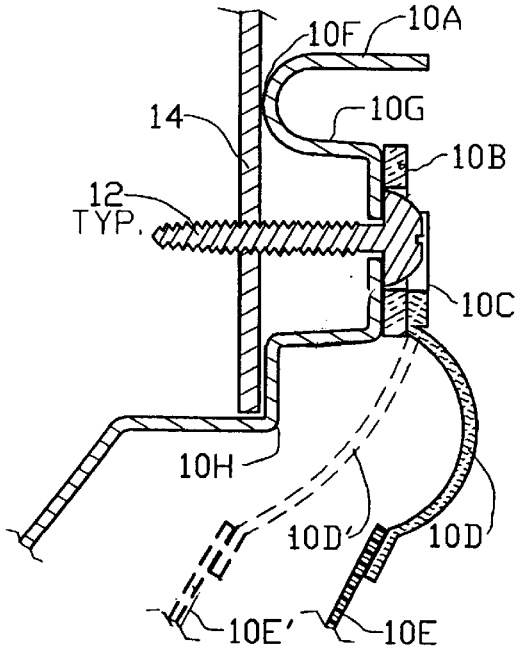
FIG. 3 PRIOR ART
FIG. 3 is an enlarged cross-section taken at axis 3-3' of FIG. 2, showing detail at a mounting screw location.

FIG. 3 is an enlarged cross-section taken at axis 3-3' of FIG. 2 showing the shape of the speaker edge region including rim 10A forming one wall of a U-shaped channel with a rounded channel bottom 10F bearing against the front of panel 14. The channel's opposite side 10G supports a flat landing region on which a surround flange 10C, extending from resilient arched suspension 10D, is adhesively attached to the speaker frame via a spacer 10B, typically made from a cardboard material. The inner flange of the resilient arched suspension 10D is attached to the outer edge of speaker cone 10E. Resilient suspension 10D and cone 10E are shown in solid lines in the normal quiescent position, and are shown in dashed lines 10D' and 10E' at an extreme limit of travel, where sufficient clearance must be provided to prevent striking the corner 10H of the speaker frame. The edge of the region of panel 14 above the speaker cutout opening 14A (FIG. 1) is seen retained against the inside of corner 10H.

When, instead of the self-threading sheet metal screw type shown, screws 12 are implemented as machine screws with rear nut fastenings, there can be a serious problem accessing the opposite side of panel 14 to hold and/or tighten the nuts since the speaker 10 occupies the mounting opening 14A (FIG. 1); two workers may be required. In thick non-metallic panels, tee-nuts are sometimes utilized, anchored into the rear of panel 14; however these tend to work loose and/or become cross-threaded, thus causing costly rework in manufacturing and in field repair.

Figure 4:
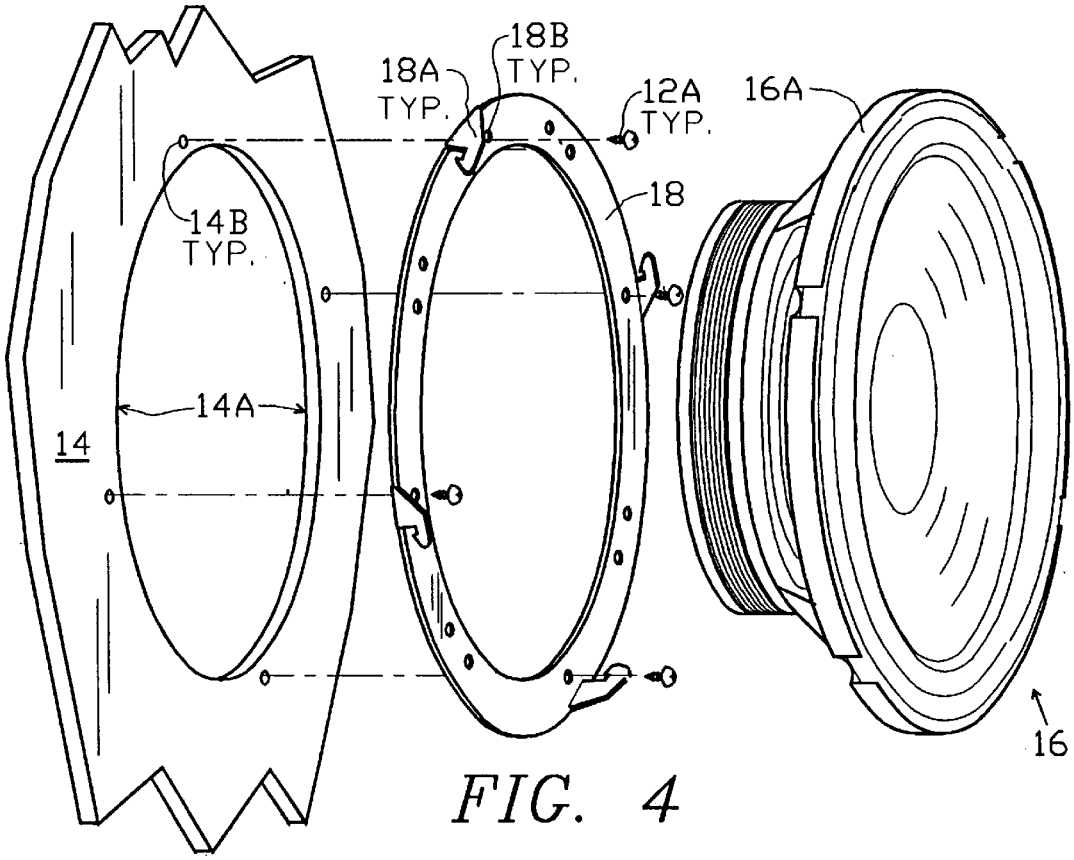
FIG. 4 is a three-dimensional view of a versatile circular speaker according the present invention, shown in a pre-installation position along with a mounting ring providing four mounting tabs for engaging slots in the speaker rim region, and a mounting panel with a standard speaker cutout as in FIG. 1.

FIG. 4 is a three-dimensional view of a versatile speaker 16 of the present invention, shown in a pre-installed disposition with a metal mounting ring 18 that enables twist-lock mounting to panel 14. In this illustrative embodiment, the frame of speaker 16 is generally shaped and dimensioned for interchangeability with the "6.5 inch" standard described in connection with FIG. 1, and may actually utilize the same basic speaker frame part with some additional machine rework involving material removal: e.g. the region of rim 16A is configured with four slots at the channel bottom (not visible in this view) which engage four corresponding tabs 18A formed on mounting ring 18, so as to provide twist-lock speaker mounting in accordance with this embodiment of the present invention.

Speaker 16, along with ring 18, is intended to be interchangeable with conventional speaker 10 of FIGS. 1–2, being mountable in the "6.5 inch" standard mounting pattern, i.e. cutout 14A and four holes 14B provided in panel 14.

Ring 18 may be fastened to panel 14, prior to mounting speaker 16, by four screws 12A, typically self-tapping screws engaging suitably sized holes 14B in panel 14. If the ring 18 is to be left mounted permanently in place on panel 14, it can be fastened in place by rivets rather than screws.

If nut fastenings are required, these can very easily be placed, started and held or tightened from the front (top as shown) through the main mounting opening 14A, since the ring 18 is attached to panel 14 prior to mounting speaker 16, this accessibility eliminates any possible need for a second worker.

Figure 5:
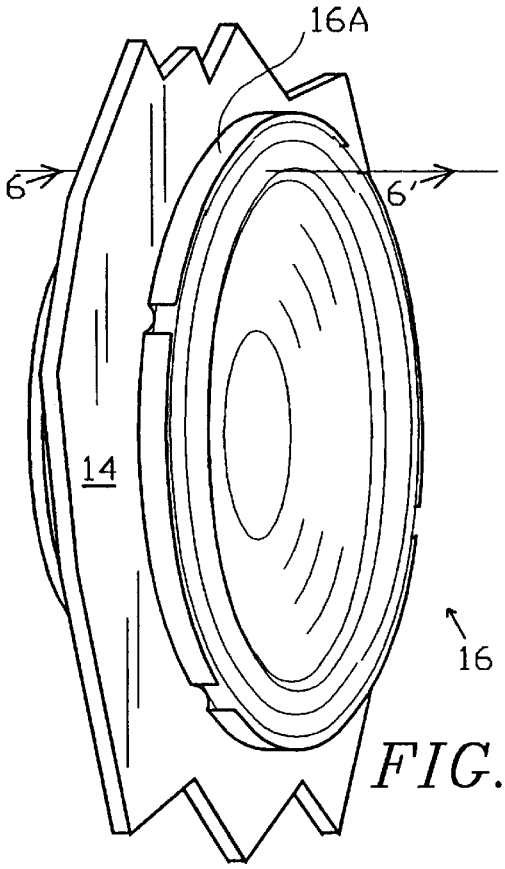
FIG. 5 shows the versatile speaker of the present invention mounted to the panel of FIG. 4 via the mounting ring of FIG. 4 in a twist-lock mounting manner.

FIG. 5 shows the verstile speaker 16 of the present invention mounted into panel 14 of FIG. 4, where it is held in place by engagement of the tabs 18A with the previously-mentioned slots in the speaker rim region. With ring 18 fastened in place on panel 14, the initial mounting of speaker 16 and any subsequent removal and reassembly thereof are easily performed in a twist-lock manner enabled by the present invention.

Figure 6:
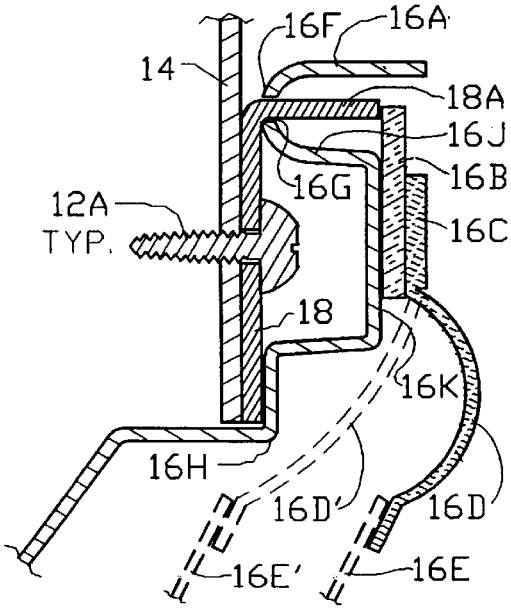
FIG. 6 is an enlarged cross-section taken at axis 6-6" of FIG. 5, showing detail at a typical mounting screw location.

FIG. 6 is an enlarged cross-section of an edge region of speaker 16 taken at a mounting screw location at axis 6-6' of FIG. 5, typical of the four locations of screws 12A and tabs 18A of ring 18. Ring 18 is secured directly and possibly permanently to panel 14 by screws 12A.

The speaker frame cross-sectional shape can be the same as in FIG. 3 except that screw clearance holes (FIG. 3), being no longer required in the landing 16K, are now eliminated, and slots 16G are configured in the rim channel trough region 16F. Speaker 16 is secured to 14 panel by tabs 18A, passing through slots 16G and, upon twist-locking, retained by detent means (to be described in more detail below in connection with FIGS. 8A and 8B).

Cone 16E is made larger than the cones described above as ordinarily utilized in speaker 10E of FIG. 1; spacer 16B and surround flange 16C are seen to be displaced upwardly on landing 16K in comparison to their counterparts 10B and 10C of FIG. 3. Suspension 16D and cone 16E are shown in the quiescent condition, located as indicated by solid lines, and in a limit travel condition, displaced as indicated by dashed lines showing cone 16E' and suspension 16D' maximally-displaced downwardly to the extent that the surround 16D' is stretched almost flat and yet there is sufficient clearance with regard to corner 16H.

Attaching ring 18 to panel 14 by screws 12A as shown allows the elimination of all holes in the region of landing 16K, and also, referring to FIG. 1 and 3, mounting holes in the surround flange 10C and spacer 10B are eliminated, thus providing in speaker 16 of the present invention a more complete and uniform interface surface at landing 16K, unobstructed by the screw heads, for adhesively attaching the surround flange 10C and spacer 10B.

FIG. 7 is a three-dimensional view showing the versatile speaker 16 of the present invention in a pre-installation position, to be mounted to a nonconventional panel 20 according an embodiment of the present invention which provides twist lock mounting in a manner that does not require a separate mounting ring 18 (FIG. 4): this is accomplished by forming mounting tabs 20A, shaped the same as tabs 18A of FIG. 4, integrally in the mounting panel 20. If panel 20 is part of a vehicle, tabs 20A would need to be formed in original manufacture, and mounting holes 14B (FIG. 4) would not be required. Alternatively, panel 20 could be provided as a removable panel in the vehicle design, enabling exchangeability of different panel configurations. After twist-lock installation in the same manner as described above in connection with ring 18, speaker 16 and panel 20 would appear as in FIG. 5.

FIG. 8A, illustrating twist-lock mounting embodiment of the present invention in reference to FIG. 7 and also generally applicable to FIGS. 4–6, is a cross-section taken at axis 8-8' of FIG. 7, after initial assembly, showing a mounting tab 20A that has entered a slot 16G in the lower rim portion 16F of speaker 16.

FIG. 8B shows the items of FIG. 8A after the speaker 16 has been rotated clockwise to a locked position such that detent 16K at the rear of the rim channel has moved upwardly as shown to where it engages the hooked tongue portion of tab 20A, thus providing twist-lock mounting of the versatile speaker 16 according to this embodiment of the present invention.

For subsequent speaker removal, speaker 16 is simply rotated counterclockwise so as to move slot 16G downward to the location shown in FIG. 8A, thus disengaging tab 20A from detent 16K and aligning slot 16G as shown so that the speaker 16 can then be easily moved to the right clear of tabs 20A and thus removed from the panel 20.

FIG. 9 is a three-dimensional exploded pre-installation view of a panel 22 having an oversize mounting hole pattern, a versatile speaker 16 of the present invention, and mounting hardware comprising four spring clips 24 and four screws 12B that enable speaker 16 to be mounted in the oversize hole pattern, utilizing four clearance notches 16L provided in the rim 16A of speaker 16.

In this embodiment of the present invention, the oversize hole pattern in panel 22 into which speaker 16 is to be mounted, is the standard mounting pattern for the aforementioned "170 mm" European style speaker frame, found in many vehicles of European origin. The main circular opening 22A is larger than openings 14A in FIG. 1 and 20A in FIG. 4, while the four mounting holes 22B are located on a circle 157 cm in diameter, which is the same dimension as the outside diameter of speaker 16.

Therefore, to enable speaker 16 to be mounted in the "170 mm" pattern, the rim region is made to have four clearance notches 16L at the four mounting locations, providing sufficient clearance for mounting screws 12B to enter the existing holes 22B available in panel 22. At each mounting location, a steel spring clip 24 engages the head of the screw 12B with speaker rim 16A: clip 24 is made substantially longer than notch 16L, so that clip 24 overspans notch 16L enabling screw 12B, engaging hole 22B, to secure the speaker rim 16*a* against panel 22.

FIG. 10 shows the verstile speaker 16 of the present invention mounted into panel 22 of FIG. 9, where it is held in place by screws 12B retaining clips 24 which engage rim 16A at the location of the notches 16L (FIG. 9).

FIG. 11 is an enlarged cross-section taken at axis 11-11' of FIG. 10 with speaker 16 mounted into the front of panel 22 utilizing spring clip 24 which bears onto rim 16A when screw 12B is tightened into mounting hole 22B of panel 22, thus pressing the bottom 16F of the speaker rim channel against the front side of panel 22 as shown.

Figure 12:
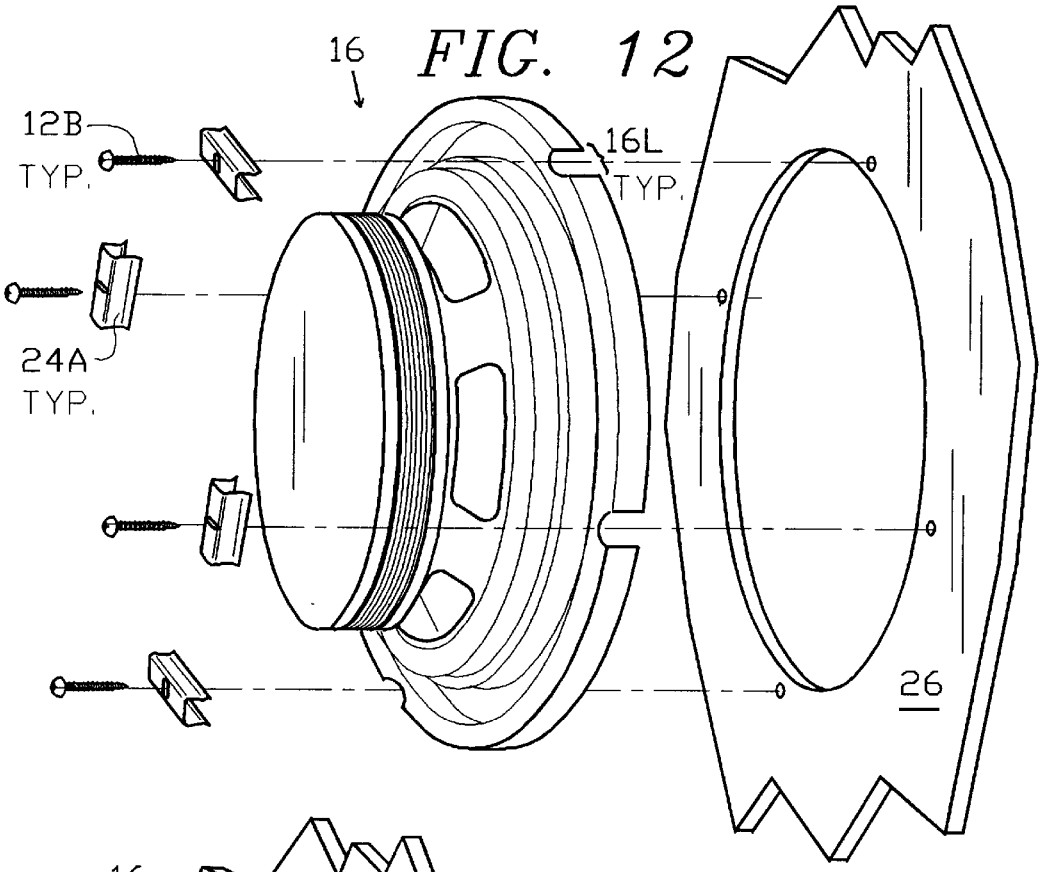
FIG. 12 is a three-dimensional exploded pre-installation view of a panel having an oversize mounting hole pattern, the versatile speaker of the present invention, and spring clip mounting hardware that enables the speaker to be mounted to the rear of the panel in the oversize hole pattern utilizing rim notches in the speaker.

FIG. 12 is a three-dimensional exploded pre-installation view of a panel 26 having an oversize mounting hole pattern, a versatile speaker 16 of the present invention, and mounting hardware comprising four spring clips 24A and four screws 12B that enable speaker 16 to be mounted against the rear of panel 26 in the oversize hole pattern, utilizing four clearance notches 16L provided in the rim of speaker 16.

Figure 13:
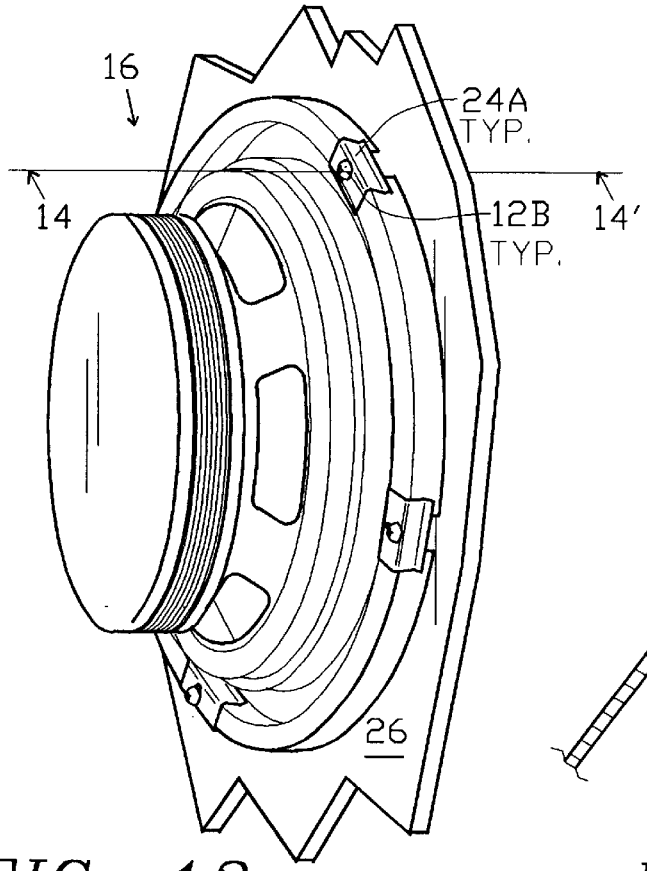
FIG. 13 shows the versatile speaker of the present invention mounted to the rear of the panel of FIG. 12 on an oversize mounting pattern, utilizing clips and screws.

FIG. 13 shows the verstile speaker 16 of the present invention mounted against the rear of panel 26 of FIG. 12, where it is held in place by screws 12B retaining clips 24A which engage rim 16A at the location of the notches 16L (FIG. 12). The steel spring clips 24A are made wide enough to encompass the U-shaped speaker rim channel, so that when screw 12B is tightened into the panel mounting hole from the rear of the panel 26 as shown, the open edge of the speaker rim becomes pressed against the rear of panel 26. This mounting arrangement could be utilized for example in a bulkhead of a vehicle behind a rear cushion, mounting the speaker 16 with its cone facing toward the front of the vehicle.

Figure 14:
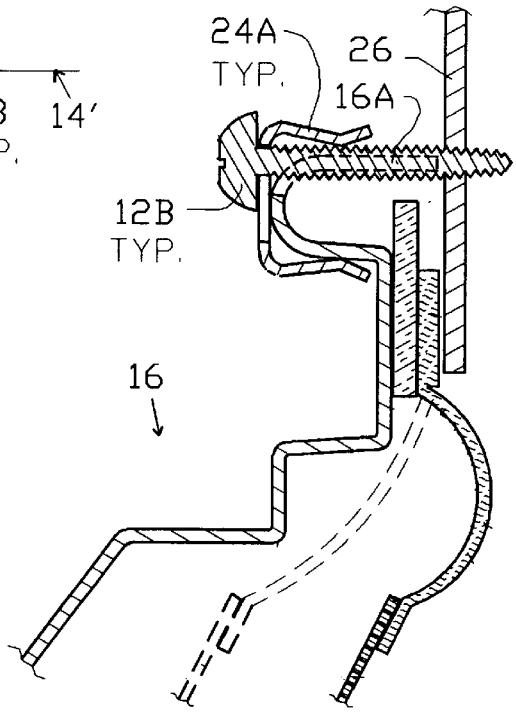
FIG. 14 is an enlarged cross-section taken at axis 14-14' of FIG. 13, showing detail at a typical mounting screw location.

FIG. 14 is an enlarged cross-section taken at axis 14-14' of FIG. 13 with speaker 16 mounted against the rear of panel 26 utilizing spring clip 24A which bears onto rim channel region when screw 12B is tightened into the corresponding mounting hole of panel 26, thus pressing the rim 16A of the speaker against the rear side of panel 26 as shown.

A factor of merit for comparing inherent LF (low frequency) capability vs size for different speaker designs can be defined as the ratio of the cone area to the frame area, both areas being calculated from diameter.

Four speaker types, i.e. the popular "6.5 inch" speaker type #1 with its standard cone and #2 with a custom oversized cone, the "170 mm" speaker type and the versatile speaker of the present invention, are compared in Table 1, as follows:

TABLE 1

LF SIZE EFFICIENCY COMPARISON - cone/frame area
Dimensions: diameter in millimeters, area in square centimeters.

| Speaker type: | 6.5"#1 | 6.5"#2 | 170 mm | Subject |
|---|---|---|---|---|
| Cone diameter Dc | 111.8 | 115.3 | 119.3 | 119.3 |
| Cone area Ac | 98.2 | 104.4 | 111.8 | 111.8 |
| Frame diameter Df | 157 | 157 | 166 | 157 |
| Frame area Af | 193.6 | 193.6 | 216.4 | 193.6 |
| LF Merit: Ac/Af | 50.7% | 53.9% | 51.7% | 57.7% |

From Table 1 it is seen that the subject versatile speaker configuration of the present invention rates higher than the other three speakers of known art that it can replace, with regard this factor of merit.

With regard to the "twist-lock" embodiment illustrated in FIGS. 4–8B, the four notches shown in the rim 16A are not utilized in this twist-lock mounting arrangement, which is generally associated with the smaller mounting pattern, e.g. the "6.5 inch" type, and thus this "twist-lock" embodiment could be implemented and practiced without the notches.

Similarly in the embodiment illustrated in FIGS. 9–11 the notches 16L are utilized but the slots 16G and tabs 18A/20A of FIGS. 4–8B are not utilized in this mounting arrangement, which is generally associated with an oversize mounting pattern, e.g. the "170 mm" type, and thus this "clip mounted" embodiment could be implemented and practiced without the slots and tabs.

While in the foregoing descriptions of illustrative embodiments the particular well known "6.5 inch" and "170 mm" speaker types and panel mounting patterns have been shown as examples of practicing the present invention, the principles of the invention as disclosed herein are generally applicable to the attainment of interchangeability between various speaker types having moderately different sizes, especially in circumstances where the speaker must be truly "versatile", i.e. readily installable into at least two different mounting patterns that cannot themselves be altered, for reasons of vehicle warranty, and since they were originated independently for distinctly different speaker types that are ordinarily non-interchangeable with regard to physical and/or performance characteristics.

The invention may be practiced with any designated number of tabs 18A/20A and corresponding slots 16G, typically within a range from 3 to 8. Ring 18 of FIG. 4 may be provided with any desired number of optional spare ring mounting holes 18B, as illustrated in FIG. 4, and any desired ones of these, corresponding to various available panel mounting holes, can be selected for receiving fastening screws 12A, typically but not necessarily in one or more uniform circular arrays.

The detented twist-locking action of the present invention can be implemented with tabs 18A and protrusion 16K configured in alternative shapes that can provide detented twist-lock speaker mounting that is functionally equivalent to that of the illustrative embodiment shown.

The invention may be embodied and practiced in other specific forms without departing from the spirit and essential characteristics thereof. The present embodiments are therefore to be considered in all respects as illustrative and not restrictive.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

We claim:

1. A structural improvement in a compact loudspeaker of a type having a sheet metal circular basket configured with a peripheral mounting flange portion having on a rear side thereof a mounting surface, adjacent to an outer rim of the flange portion, intended to interface with a front surface of an associated baffle panel, and having on a front side of the mounting flange portion, a flat forward-facing suspension-attachment surface, parallel to the rear mounting surface, configured with a polar array of standard mounting holes, located on a circle of standard mounting diameter concentric with the basket, for accommodating screw type mounting means, said loudspeaker being originally designed to utilize a standard cone of designated effective diameter attached via surrounding compliant suspension means to the suspension-attachment surface of the basket rim, the improvement comprising:

a modification of the basket wherein the mounting flange portion thereof is further configured with a plurality of special mounting openings arranged in a polar array located on a special mounting circle concentric with the outer rim, the special mounting circle having a diameter appreciably greater than the standard mounting diameter; and a special cone installed in said loudspeaker instead of the standard cone, said special cone having an effective diameter larger than that of the standard cone, thus providing improved performance;

whereby the improved loudspeaker can be mounted to the baffle panel via the special mounting openings in a manner to accommodate the special cone and to accommodate a variety of baffle panel mounting configurations.

2. The structural improvement in a compact loudspeaker as defined in claim 1 wherein the outer rim of the flange portion of the basket is made to have a cross-section configured as a U-shaped channel having a semicircular portion extending rearwardly so as to form a rear mounting surface of the U-shaped channel, and wherein the mounting openings are configured as elongated rectangular slots located on the rear mounting surface of the U-shaped channel and oriented tangentially relative to the special mounting circle;

whereby a loudspeaker incorporating the improvement can be removably mounted in a twist-lock manner in engagement with a corresponding plurality of flag-shaped lock tabs provided in connection with the baffle panel, protruding perpendicularly therefrom, the twist-lock manner involving rotation of the loudspeaker relative to the lock tabs.

3. The structural improvement in a compact loudspeaker as defined in claim 2 wherein the number of slots is four.

4. The structural improvement in a compact loudspeaker as defined in claim 1 wherein the mounting openings are configured as gaps in the annular outer rim, each gap further including a generally semicircular opening in the landing region;

whereby a loudspeaker incorporating the improvement can be mounted to the baffle panel utilizing hardware means including screw fasteners located at each gap.

5. The structural improvement in a compact loudspeaker as defined in claim 4 wherein the number of gaps is four.

6. The structural improvement in a compact loudspeaker as defined in claim 4 further comprising the baffle panel having a front surface thereof interfacing the rear mounting surface of the flange portion of said loudspeaker.

7. The structural improvement in a compact loudspeaker as defined in claim 4 further comprising the baffle panel having a rear surface thereof interfacing a front mounting region of the flange portion of said loudspeaker.

8. A structural improvement in a compact loudspeaker system wherein a compact loudspeaker of a type having a sheet metal circular basket configured with a Peripheral mounting flange portion having on a rear side thereof a mounting surface, adjacent to an outer rim of the flange portion, intended to interface with a front surface of an associated baffle panel, the front side of the mounting flange portion defining a flat forward-facing suspension-attachment surface, parallel to the rear mounting surface, configured with a solar array of standard mounting holes, located on a circle of standard mounting diameter concentric with the basket, for accommodating screw type mounting means, said loudspeaker being originally designed to utilize a standard cone of designated effective diameter attached via surrounding compliant suspension means to the suspension-attachment surface of the basket rim, the improvement comprising:

a modification of the basket wherein the mounting flange portion thereof is further configured with a plurality of special mounting openings arranged in a Polar array located on a special mounting circle concentric with the outer rim, the special mounting circle having a diameter appreciably greater than the standard mounting diameter; and a mounting ring constructed from sheet metal and arranged to have an outer diameter approximating that of the special mounting circle and an inner diameter approximating that of the port opening, configured to include the lock tabs and to thus be removably attachable to the loudspeaker via the rectangular slots thereof in a twist-lock manner involving rotation of the loudspeaker relative to the ring;

whereby, with the ring affixed to the front surface of the baffle panel, said loudspeaker can be removably attached to the baffle panel in the twist-lock manner.

9. The structural improvement in a compact loudspeaker system as defined in claim 8, further comprising:

a special cone installed in said loudspeaker instead of the standard cone, said special cone having an effective diameter larger than that of the standard cone, thus providing improved performance.

10. A twist-lock loudspeaker mounting system for mounting a circular loudspeaker to a baffle panel having a circular acoustic port opening of designated diameter, comprising:

a peripheral circular rim portion of the loudspeaker configured to have a designated outer diameter and a rear surface constructed and arranged to mount against a front surface of the baffle panel, said rim portion being configured to have in the rear surface thereof a plurality of elongated slots arranged in a polar array defining a special mounting circle, concentric with rim portion, having a diameter substantially greater than that of the acoustic port opening and approaching the outer diameter of the rim portion, the slots being dimensioned with a designated slot length and oriented end-to-end; and a corresponding plurality of lock tabs provided on the baffle panel protruding perpendicularly therefrom, located around the circular opening thereof, said lock tabs being shaped in a manner to enable the loudspeaker to be installed securely in the baffle panel and removed therefrom in a twist-lock manner.

11. The twist-lock loudspeaker mounting system as defined in claim 10 wherein the shaped lock tabs are each configured to each have an end portion of width approaching the slot length and a base portion, adjacent the baffle panel, of reduced width so as to define an L shape of the lock tab that allows the end portion to pass through the slot, thus allowing the rear surface of the loudspeaker rim portion to mount against the front surface of the baffle panel, and to then lock in place when rotation of the loudspeaker offsets the end portion of the lock tab beyond the slot, whereby the loudspeaker becomes locked in a mounted operating condition, from which it can be demounted, after rotating the loudspeaker in an opposite direction so to unlock it, by moving the loudspeaker away from the baffle panel, thus withdrawing the lock tabs through the slots.

12. The twist-lock loudspeaker mounting system as defined in claim 11 wherein the shaped lock tabs are originally fabricated from sheet metal as outward extensions from an outer circumference of a mounting ring having an outer diameter approximating that of the special mounting circle and an inner diameter approximating that of the acoustic port, the tabs being bent perpendicular to the ring at the outer circumference thereof, the ring being affixed to the front surface of the baffle panel concentrically surrounding the acoustic port opening.

13. The twist-lock loudspeaker mounting system as defined in claim 11 wherein the baffle panel is made from sheet metal and the shaped lock tabs are formed from the sheet metal in a piercing and bending process.

14. An improved compact circular twist-lock-mountable loudspeaker comprising:

a sheet metal basket configured with a peripheral mounting flange portion having an annular outer rim forming a first sidewall of a peripheral channel having a generally U-shaped cross-section of which a curved portion defines a peripheral rear mounting surface of said loudspeaker, the mounting flange portion providing a flat forward-facing suspension-attachment surface, parallel to the rear mounting surface;

a cone of unusually large size relative to said basket, mounted peripherally via a flexible surround support element having a peripheral portion adhesively attached to the flat suspension-attachment surface;

the annular outer rim being configured with four generally rectangular gap portions arranged in a polar array, each extending to a semicircular gap portion in the curved portion of U-shaped cross section, whereby said loudspeaker can be fastened to a baffle panel utilizing four corresponding screw type fasteners located on a circle coinciding approximately with the annular outer rim;

the peripheral rear mounting surface being configured with four elongated slots located in a polar array and oriented tangentially relative to a mounting circle of designated diameter coinciding with the rear mounting surface, whereby the loudspeaker can be removably mounted in a twist-lock manner in engagement with a corresponding plurality of flag-shaped lock tabs provided in connection with the baffle panel, protruding perpendicularly therefrom;

whereby said flat suspension-attachment surface is caused to remain free of obstruction due to mounting hardware and free of any requirement for openings for loudspeaker mounting hardware, and whereby the loudspeaker can be mounted to a variety of baffle panels having differently-dimensioned panel loudspeaker opening patterns.

* * * * *